United States Patent [19]

Alaniz et al.

[11] Patent Number: 5,046,194

[45] Date of Patent: Sep. 10, 1991

[54] SUIT FOR WEIGHT LIFTERS

[76] Inventors: Irma P. Alaniz, 921 Rickey; Pedro M. Alaniz, III, 901 Lansdown, both of Corpus Christi, Tex. 78412

[21] Appl. No.: 658,309

[22] Filed: Feb. 19, 1991

Related U.S. Application Data

[63] Continuation-in-part of Ser. No. 387,527, Jul. 31, 1989.

[51] Int. Cl.[5] ..... A41D 1/08; A41D 13/00

[52] U.S. Cl. ..... 2/69; 2/78 A; 2/79; 2/243 R; 2/243 B

[58] Field of Search ..... 2/2, 2.1 R, 69, 78 R, 2/78 A, 79, 227, 243 R, 243 A, 243 B, 67, 113, 115; 450/6, 7, 11, 12, 21, 22, 120, 123, 124; 272/93, 116, 143

[56] References Cited

U.S. PATENT DOCUMENTS

| | | | |
|---|---|---|---|
| 882,181 | 3/1908 | Thomas | 272/143 |
| 1,562,720 | 11/1925 | Pettee et al. | 2/67 X |
| 1,711,362 | 4/1929 | Neilson | 2/78 A |
| 1,723,402 | 8/1929 | Browdy | 2/78 A |
| 1,897,619 | 2/1933 | Powell | 2/78 R |
| 1,957,102 | 5/1934 | Earnshaw | 2/67 |
| 2,352,128 | 6/1944 | Shikles, Jr. | 2/78 R |
| 2,553,301 | 5/1951 | Colby | 450/124 X |
| 2,554,380 | 5/1951 | Olrich et al. | 2/113 |
| 2,664,566 | 1/1954 | Mianulli | 2/2 |
| 2,871,849 | 2/1959 | Chatham et al. | 450/11 |
| 3,255,459 | 6/1966 | Way | 2/67 |
| 3,255,756 | 6/1966 | Frei | 450/124 |
| 3,774,052 | 7/1973 | Rector | 2/201 R |
| 4,065,814 | 1/1978 | Fox | 2/79 |
| 4,089,064 | 5/1978 | Chandler, Jr. | 272/143 |
| 4,625,336 | 12/1986 | Derderian | 2/227 X |
| 4,698,847 | 10/1987 | Yoshihara | 2/67 X |
| 4,731,882 | 3/1988 | Ekman | 2/79 X |
| 4,763,498 | 10/1973 | Rector | 2/79 X |
| 4,862,523 | 9/1989 | Lipov | 2/409 |
| 4,875,236 | 10/1989 | Boynton | 2/67 |

FOREIGN PATENT DOCUMENTS

| | | | |
|---|---|---|---|
| 2361269 | 3/1978 | France | 2/2.1 R |
| 2189375 | 10/1987 | United Kingdom | 2/243 R |

*Primary Examiner*—Werner H. Schroeder
*Assistant Examiner*—Jeanette E. Chapman
*Attorney, Agent, or Firm*—G. Turner Moller

[57] ABSTRACT

A weight lifting suit is made of a series of panels connected together by seams which provide a harness or supportive seat into which the lifter sits during a squatting movement. The harness brakes the lifters descent and provides rebound out of the seated or squat position thus enabling the lifter to lift more weight.

10 Claims, 2 Drawing Sheets

FIG. 5-A
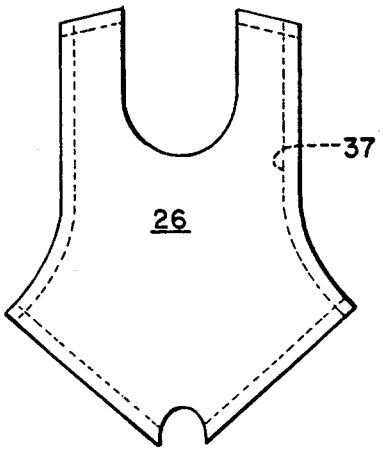
FIG. 5-B
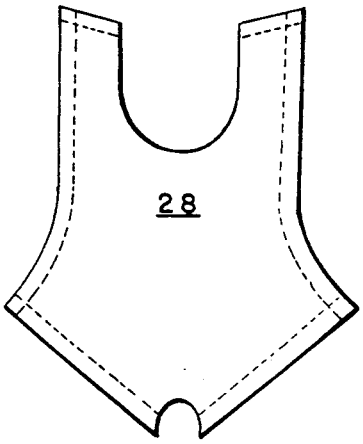
FIG. 5-C
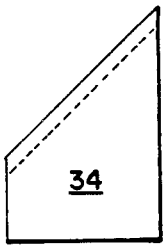
FIG. 5-D
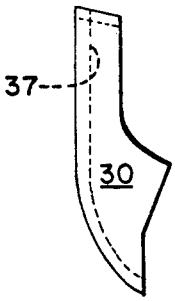
FIG. 5-E
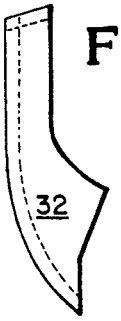
FIG. 5-F
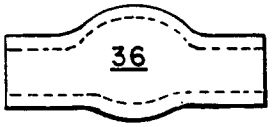

SUIT FOR WEIGHT LIFTERS

This application is a continuation-in-part of application Ser. No. 07/387,527, filed July 31, 1989.

This invention relates to a suit for people who lift weights for pleasure, exercise or in competition.

Although powerlifting and weightlifting have distinct and sometimes subtle differences, the term weightlifting is used as a generic term for both activities. The governing bodies of weightlifting competition have certain standards or regulations governing the design and construction of weightlifting suits. These regulations are intended, among other things, to limit, minimize or prevent the suit from actively assisting the lifter. Thus, one of the prohibitions in the design and construction of weight lifting suits is that it cannot employ elastic materials and the authorized fabrics have a limited capacity for stretch.

Although there has been a good deal of evolution of weightlifting suits in the last few years, it must be admitted that the advantages of recent suits appear to be more psychological than functional. This is not to denigrate the mental aspects of the sport because, at higher competitive levels, the psychological aspects distinguish the winners from the losers. As Yogi Berra stated in a similar context, half of this game is two thirds mental.

Weight lifter's suits are of one piece or unitary construction and broadly comprise a torso section having a shoulder strap running over each shoulder and a pants section having a crotch and a pair of relatively short legs. Typically, a suit is made of three panels. One panel provides the front torso including the front straps while a second panel provides the back torso including the back straps. A smaller panel provides a crotch/leg section. A pair of more-or-less parallel seams extend upwardly along each leg and connect the small panel to the two torso panels so the two torso panels provide the outside of the legs and the small panel provides the inside. The material of the suit of this invention may be of any suitable type. Preferably, it is a woven or knitted fabric having a multiplicity of vertical ribs, no discernable elasticity in the horizontal direction and a small but discernable amount of elasticity in the vertical direction.

Disclosures of some interest relative to this invention are found in U.S. Pat. Nos. 1,582,815; 1,897,619; 2,352,128; 4,065,814 and 4,625,336.

In the suit of this invention, a harness or supporting seat is created into which the lifter sits during a squatting movement. This harness is constructed of seams which, in action, brake the lifters descent and provide rebound out of the seated or squat position, thus enabling the lifter to lift more weight. This is accomplished through the use of seams sewn into the material of the suit, as when joining two fabric panels together. The seams are preferably on the large size to provide more material and thus more energy storage capacity. The material used is the same conventional weight lifting suit fabric described above having a multiplicity of vertical ribs, no elasticity transverse to the ribs and some elasticity parallel to the ribs. Because it is desired to provide the seams with an elastic component, the ribs in the material extend vertically, or at least not horizontally, in the seams.

In a preferred embodiment of this invention, a large seam runs over each of the shoulder straps and down the front and back of the suit. The shoulder strap seams extend downwardly and are parallel for a distance. The seams then more-or-less gradually diverge toward the sides of the suit and meet at a convergence point above the lifter's waist. The shoulder strap seams thus provide the upper end of the harness on each side of the suit. At the convergence points, a pair of seams converge downwardly in front toward the crotch and a pair of seams converge downwardly in back around the buttock. These seams connect to the conventional crotch/leg seams to provide the bottom of the harness.

It is an object of this invention to provide an improved weightlifting suit.

Another object of this invention is to provide a weightlifting suit using seams as a loadable slightly elastic harness into which the lifter sits during a squatting movement.

Other objects and advantages of this invention will become more fully apparent as this description proceeds, reference being made to the accompanying drawings and appended claims.

IN THE DRAWINGS

FIGS. 5A–5F are a collection of fabric panels from which the suit of FIGS. 1–4 is made.

Figure 1:
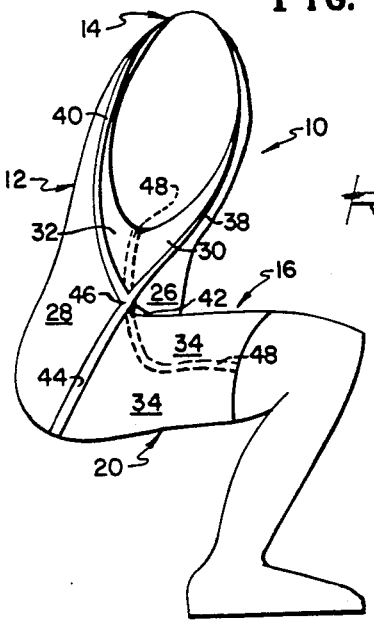
FIG. 1 is a side elevational view of a lifter in a squatting position, illustrating the suit of this invention in a stressed position.

Referring to FIGS. 1–5F, there is illustrated a weightlifting suit 10 of this invention comprising a torso section 12 having a pair of shoulder straps 14 and a pants section 16 having a crotch and a pair of legs 20. The suit 10 is, of course, of sturdy one piece construction as will become evident hereinafter. The suit 10 is substantially symmetrical because the front and back are substantially identical. In addition, the left and right halves of the suit 10 are symmetrical about a central plane.

Figure 4:
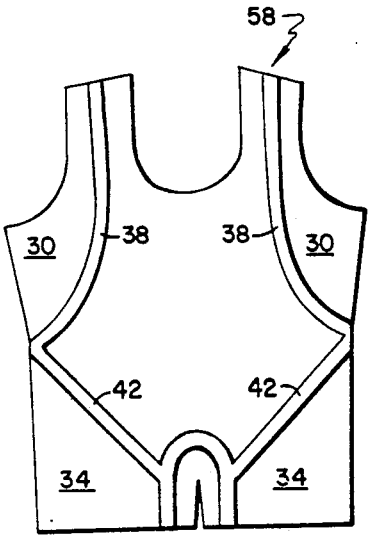
FIG. 4 is a front view of suit of this invention which is the same as a back view of the suit of this invention.
Figure 3:
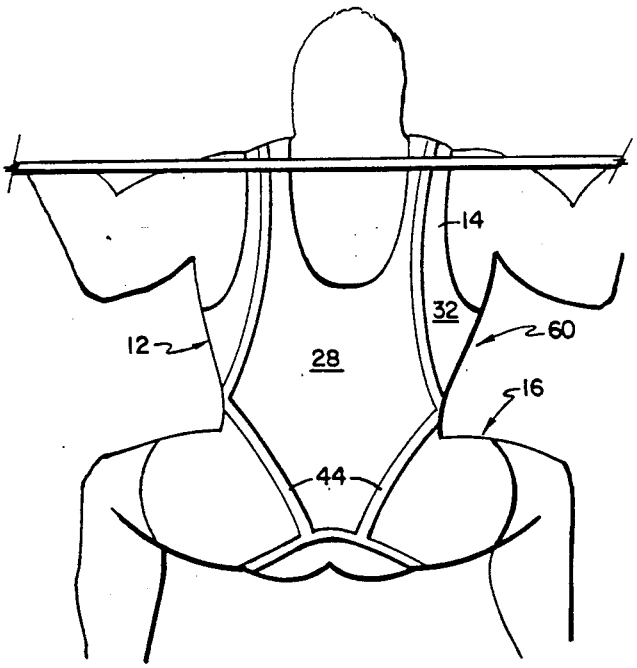
FIG. 3 is a back view of the lifter of FIGS. 1 and 2.

As shown in FIG. 4, the seams appear fairly straight when the suit 10 is merely laying flat. When worn by the weight lifter, the seams lie along the body of the lifter and are thus slightly distorted and more curved because the suit 10 tightly fits the lifter.

The suit 10 comprises a series of panels or segments cut from the material as shown in FIGS. 5A–5F. The suit 10 accordingly includes front and back panels 26, 28, two pairs of front and back outer strap panels 30, 32, four interchangeable leg panels 34 and a crotch panel 36. It will be evident that the suit 10 is substantially more expensive than prior art suits because of the labor necessary to sew all of the panels together. The prior art suit has only side seams connecting the analogous front and back panels together along the sides and the seams connecting the crotch panel to the remaining panel.

The panels 26, 28, 30, 32, 34, 36 may be sewn together in any desired order. As seen best in FIGS. 2 and 5A–5F, when the outer strap panel 30 is sewn onto the right side of the front panel 26, a seam 38 is formed on the right front of the panel 26. Specifically, the outer strap panel 30 is sewn to the front panel 26 so the material between the dotted lines 37, which represent lines of stitches to produce parallel stitch lines in the seams 38, overlaps to create the seam 38. When the outer strap panel 30 is sewn onto the left side of the front panel 26, a seam 38 is formed on the left side of the panel. When the right leg panel 34 is sewn onto the right side of the panel 26, a seam 42 is formed. When the left leg panel 34 is sewn onto the left side of the front panel 26, a seam 42 is also formed. This completed assembly represents the full front 58 of the suit 10 shown in FIG. 4.

The full back panel 60 of the suit 10 is constructed by sewing the right outer strap panel 32 onto the right side of the back panel 28, resulting in the formation of a seam 40. When the outer strap panel 32 is sewn onto the left side of the back panel, a seam 40 is formed on the left side of the back panel. When the right leg panel 34 is sewn onto the right back panel 28, a seam 44 is formed. When the left leg panel 34 is sewn onto the left back panel 28, a seam 44 is formed.

The full front panel 58 and the full back panel 60 are then sewn onto the crotch panel 36. The full front and back panels 58, 60 are then sewn together to form seams 48 on both sides of the suit 10. The seams 38, 40, 42, 44, 48 accordingly meet at a convergence point or area 46 above the waist of the lifter. The seams 48 stabilize the convergence point 46, preventing it from shifting around and thus provide more efficient performance of the harness.

Figure 2:
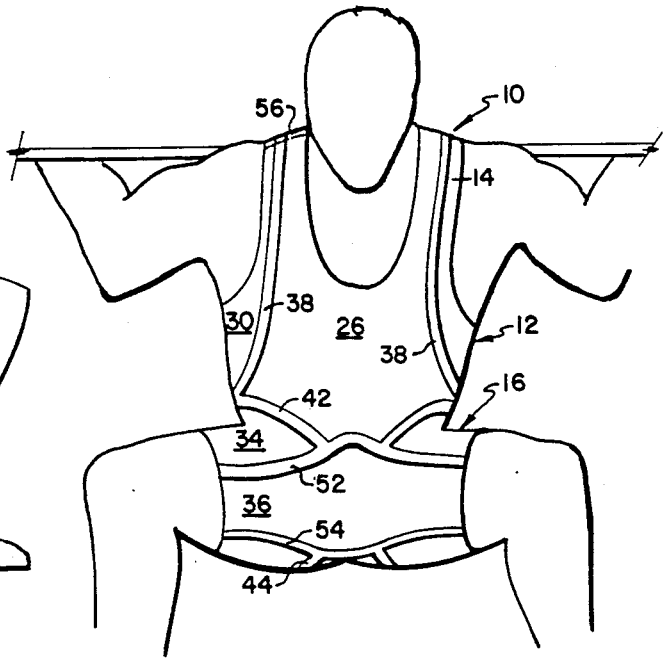
FIG. 2 is a front view of the lifter of FIG. 1.

As shown best in FIG. 2, when the crotch panel 36 is sewn to the leg panels 34, front panel 26 and rear panel 28 form a pair of more-or-less parallel seams 52, 54. When the tops of the panels 26, 28, 30, 32 are sewn together, a seam 56 is formed. In this embodiment, the seam is formed by joining the angled cuts of the upper panels 26, 28, 30, 32 which provide for easier sewing. This is due to the fact that the angles prevent the seams from folding over onto themselves, thus providing less bulky seams which easily pass between the sewing foot and the platen. It will accordingly be seen that the seams 38, 40 provide the upper end of the right side of a harness or support into which the lifter sits during a squatting or sitting movement. The lower end of the right side of the harness is provided by the seams 42, 44 which are anchored to the crotch panel 36 at the junction of the seams 42, 52 and 44, 54. The left side of the harness is provided by the mirror image seams on the left side of the suit 10.

The seams 38, 40, 42, 44 are capable of slowing down or braking the lifter's descent into the sitting or squatting position and provide rebound out of the seated position thereby enabling the lifter to lift more weight. Because the suit 10 in fact provides active assistance to the lifter, the lifter believes that he or she is capable of lifting more weight and the psychological boost reinforces the physical assistance and, in fact, more weight is lifted.

The suit 10 is made of a conventional weight lifting suit material comprising a multiplicity of ribs, which in the finished suit, extend vertically. The material is a woven fabric having almost no elasticity transverse to the ribs, but some discernable elasticity parallel to the ribs. One would think that the effect of the seams 38, 40, 42, 44 depends on the elasticity of the material in the vertical direction. This turns out not to be the case and suitable fabrics may have varying degrees of elasticity—from substantially no stretch to a good amount of stretch. Less vertical elasticity provides greater support but is less comfortable.

As will be evident to those skilled in the art, the seam 56 is a convenience seam and the suit 10 may be made of a unitary front and back panel, and unitary outer strap panels 30, 32 to eliminate the top seam 56. Similarly, the crotch panel 36 may be unitary with either the front or back panel 26, 28 to eliminate part of one of the seams 52, 54.

Although this invention has been disclosed and described in its preferred form with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A weight lifting suit comprising a torso section having a front, a back and shoulder straps and a pants section having a crotch and legs extending from the crotch, the torso and pants section being made of panels having edges overlapping one another along a narrow path adjacent the panel edges and having a pair of first seams joining the panels together in an overlapped joint extending over and down the front and back of the torso section along the shoulder straps and diverging in the torso section to opposite sides of the suit and a pair of second seams joining the panels together in an overlapped joint and joining with the first seams and converging into the crotch.

2. The weight lifting suit of claim 1 wherein the legs are made of panels overlapping one another along a narrow peripheral path having a pair of third and fourth parallel seams joining the panels together in an overlapped joint and extending upwardly along the inside of the legs, the second seams having an origin at the third seams, extending around opposite sides of the suit and terminating at the fourth seams.

3. The weight lifting suit of claim 2 wherein each leg includes a first panel overlapping a narrow path along one edge of the torso panel and providing the second seam therebetween, the crotch comprising a third panel overlapping a narrow path along one edge of the first leg panels and providing therebetween the third and fourth seams, the torso panel extending into the crotch.

4. The weight lifting suit of claim 3 wherein the torso section comprises a first torso panel extending in one direction into the crotch and extending in an opposite direction comprising part of the shoulder strap, and.

a second torso panel overlapping a narrow path along one edge of the first torso panel and comprising part of the shoulder strap, the first seams joining the first and second torso panels together in an overlapped joint.

5. The weight lifting suit of claim 1 wherein the pair of first seams extend over a top of the shoulder straps along a first path on the front of the torso section and along a second path on the back of the torso section, the first seams diverging away from each other in a central part of the torso section to opposite sides of the suit, each of the first seams defining a closed loop having an upper end at the top of the shoulder straps and a lower end at a convergence point on the side of the suit.

6. The weight lifting suit of claim 5 wherein each of the second seams includes an upper end at the convergence point.

7. The weight lifting suit of claim 1 wherein the suit is made of a material having substantially greater elasticity in the vertical direction than in the horizontal direction.

8. The weight lifting suit of claim 1 wherein the torso section and the pants section are of single ply.

9. The weight lifting suit of claim 8 wherein the torso section and pants section are free of parallel seams providing fabric channels therebetween

10. The weight lifting suit of claim 1 wherein the torso section and pants section are free of fabric channels bounded by the first and second seams.

* * * * *